US008047874B2

(12) United States Patent
Ito

(10) Patent No.: US 8,047,874 B2
(45) Date of Patent: Nov. 1, 2011

(54) HIGH-DENSITY CONNECTOR FOR HIGH-SPEED TRANSMISSION

(75) Inventor: Toshiyasu Ito, Tougane (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 33 days.

(21) Appl. No.: 12/677,283

(22) PCT Filed: Jul. 24, 2008

(86) PCT No.: PCT/JP2008/063306

§ 371 (c)(1),
(2), (4) Date: Mar. 9, 2010

(87) PCT Pub. No.: WO2009/041152

PCT Pub. Date: Apr. 2, 2009

(65) Prior Publication Data

US 2010/0330844 A1 Dec. 30, 2010

(30) Foreign Application Priority Data

Sep. 28, 2007 (JP) ..... 2007-254698

(51) Int. Cl.
*H01R 13/648* (2006.01)

(52) U.S. Cl. ..... 439/607.1

(58) Field of Classification Search ..... 439/607.1, 439/607.09, 607.05, 607.08, 83, 608
See application file for complete search history.

(56) References Cited

U.S. PATENT DOCUMENTS 4,846,727 A 7/1989 Glover et al.
4,975,084 A 12/1990 Fedder et al.
5,104,341 A 4/1992 Gilissen et al.
5,174,770 A * 12/1992 Sasaki et al. ..... 439/108
5,215,473 A 6/1993 Brunker et al.
5,645,436 A 7/1997 Shimizu et al.
5,741,144 A 4/1998 Elco et al.
(Continued)

FOREIGN PATENT DOCUMENTS

JP 02-137775 5/1990
(Continued)

OTHER PUBLICATIONS

Official Letter in Japanese Patent Appln. No. 2008-238319: Decision to Grant a Patent (Jul. 7, 2010).
(Continued)

*Primary Examiner* — Neil Abrams
*Assistant Examiner* — Harshad Patel
(74) *Attorney, Agent, or Firm* — Finnegan, Henderson, Farabow, Garrett & Dunner, LLP

(57) ABSTRACT

The high-density connector for high-speed transmission comprises a female connector having a connector body formed with a plurality of contact accommodating concave portions and a plurality of female contacts, and a male connector having a connector body and a plurality of male contacts. The female contacts are arranged in zigzag in a plurality of rows such that adjacent female contacts in a front-back direction are diagonally positioned to each other. Contact portions of the male contacts are arranged in zigzag in a plurality of rows corresponding to the arrangement of the female contacts. Among the rows of the female contacts, two adjacent rows in the front-back direction are rows of a pair of signal line contacts, and one row on either side in the front-back direction of the pair of signal line contacts is a row of a ground contact.

4 Claims, 20 Drawing Sheets

U.S. PATENT DOCUMENTS 5,795,191 A 8/1998 Preputnick et al.
5,817,973 A 10/1998 Elco
5,961,355 A 10/1999 Morlion et al.
6,024,584 A 2/2000 Lemke et al.
6,042,389 A 3/2000 Lemke et al.
6,079,991 A 6/2000 Lemke et al.
6,093,035 A 7/2000 Lemke et al.
6,133,523 A 10/2000 Elco
6,146,203 A 11/2000 Elco et al.
6,164,983 A 12/2000 Lemke et al.
6,210,182 B1 4/2001 Elco et al.
6,241,535 B1 6/2001 Lemke et al.
6,325,644 B1 12/2001 Lemke et al.
6,358,068 B1 3/2002 Houtz
6,409,543 B1 6/2002 Astbury, Jr. et al.
6,425,785 B1 * 7/2002 Azuma ..... 439/733.1
6,461,202 B2 10/2002 Klinie
6,476,316 B1 11/2002 Elco
6,517,360 B1 2/2003 Cohen
6,540,522 B2 4/2003 Sipe
6,551,140 B2 4/2003 Billman et al.
6,602,095 B2 8/2003 Astbury, Jr. et al.
6,623,302 B2 9/2003 Billman et al.
6,623,310 B1 9/2003 Billman et al.
6,634,908 B1 10/2003 Billman et al.
6,638,079 B1 10/2003 Billman et al.
6,638,110 B1 10/2003 Billman
6,641,438 B1 11/2003 Billman
6,645,009 B1 11/2003 Billman et al.
6,652,318 B1 11/2003 Winings et al.
6,652,319 B1 11/2003 Billman
6,663,401 B2 12/2003 Billman et al.
6,663,427 B1 12/2003 Billman et al.
6,682,369 B1 1/2004 Korsunsky et al.
6,692,272 B2 2/2004 Lemeke et al.
6,692,305 B2 2/2004 Nelson et al.
6,705,895 B2 3/2004 Hasircoglu
6,712,646 B2 3/2004 Shindo
6,739,918 B2 5/2004 Cohen et al.
6,746,278 B2 6/2004 Nelson et al.
6,749,468 B2 6/2004 Avery
6,758,695 B2 * 7/2004 Pepe et al. ..... 439/607.08
6,764,340 B2 7/2004 Toda
6,764,349 B2 7/2004 Provencher et al.
6,769,935 B2 8/2004 Stokoe et al.
6,808,399 B2 10/2004 Rothemel et al.
6,808,419 B1 10/2004 Korsunsky et al.
6,817,868 B2 11/2004 Matsuo et al.
6,827,611 B1 12/2004 Payne et al.
6,843,686 B2 1/2005 Ohnishi et al.
6,848,917 B2 2/2005 Lang et al.
6,851,980 B2 2/2005 Nelson et al.
6,863,549 B2 3/2005 Brunker et al.
6,872,085 B1 3/2005 Cohen et al.
6,875,031 B1 4/2005 Korsunsky et al.
6,884,117 B2 4/2005 Korsunsky et al.
6,890,215 B2 5/2005 Lang et al.
6,918,789 B2 7/2005 Lang et al.
6,923,664 B2 8/2005 Ito et al.
6,939,173 B1 9/2005 Elco et al.
6,945,787 B2 9/2005 Matsuo
6,976,886 B2 12/2005 Winings et al.
6,981,898 B2 1/2006 Akama et al.
6,986,682 B1 1/2006 Jeon
6,988,902 B2 1/2006 Winings et al.
6,994,569 B2 2/2006 Minich et al.
7,040,901 B2 5/2006 Benham et al.
7,044,793 B2 5/2006 Takemasa
7,059,907 B2 6/2006 Winings et al.
7,083,432 B2 8/2006 Hull et al.
7,094,102 B2 8/2006 Cohen et al.
7,101,191 B2 9/2006 Benham et al.
7,108,556 B2 9/2006 Cohen et al.
7,112,098 B2 9/2006 Matsuo et al.
7,114,964 B2 10/2006 Winings et al.
7,118,391 B2 10/2006 Minich et al.
7,121,889 B1 10/2006 Jeon
7,131,870 B2 11/2006 Whiteman, Jr. et al.
7,168,964 B2 1/2007 Lemke et al.
7,186,123 B2 3/2007 Lemke et al.
7,278,886 B2 * 10/2007 Cohen et al. ..... 439/607.08
7,476,110 B2 1/2009 Lemke et al.
2002/0123254 A1 9/2002 Kato et al.
2003/0171010 A1 * 9/2003 Winings et al. ..... 439/55
2004/0029410 A1 2/2004 Akama et al.
2004/0092143 A1 5/2004 Fromm et al.
2007/0059952 A1 * 3/2007 Raistrick et al. ..... 439/74
2007/0190825 A1 * 8/2007 Shuey et al. ..... 439/108

FOREIGN PATENT DOCUMENTS

JP 02-265183 10/1990
JP 11-250996 9/1999
JP 2000-311749 11/2000
JP 2002-075544 3/2002
JP 2002-117938 4/2002
JP 2002-513502 5/2002
JP 3326507 7/2002
JP 3413080 3/2003
JP 3470318 9/2003
JP 2004-6373 1/2004
JP 2004-521448 7/2004
JP 2004-363032 12/2004
JP 3754959 12/2005
JP 2006-066381 3/2006
JP 2007-115707 5/2007
WO WO 02/060011 8/2002
WO WO 03/065512 8/2003

OTHER PUBLICATIONS

International Search Report from the Japanese Patent Office mailed Aug. 19, 2008, for International Application No. PCT/JP2008/063306, filed Jul. 24, 2008.

Office Action of co-pending U.S. Appl. No. 11/902,474 dated Jun. 12, 2009.

Office Action of co-pending U.S. Appl. No. 11/902,474 dated Jan. 28, 2009.

* cited by examiner

HIGH-DENSITY CONNECTOR FOR HIGH-SPEED TRANSMISSION

TECHNICAL FIELD

The present invention relates to a high-density connector for high-speed transmission that makes a high-density connection between electrical components such as between printed circuit boards, between a printed circuit board and a flexible cable, or between flexible cables, where a signal is transmitted at high speed.

BACKGROUND ART

As a high-density connector that makes a connection between printed circuit boards as electrical components, there is conventionally known a high-density connector disclosed in Patent Document 1. In the high-density connector disclosed in Patent Document 1, signal line contacts are mutually arranged in zigzag in order to enable high-speed transmission of a signal and high-density connection of signal lines.

Patent Document 1: Japanese Patent No. 3413080

DISCLOSURE OF THE INVENTION

Such a high-density connector transmits a signal between printed circuit boards at high speed, and is therefore required to include ground contacts in order to suppress the occurrence of crosstalk between signal lines, noise, and the like. In the high-density connector disclosed in the above Patent Document 1, the ground contacts are basically arranged so as to be orthogonal to the signal line contacts.

However, when a density of the signal line contacts is further increased, in the arrangement in which the signal line contacts and ground contacts are orthogonal to each other, the ground contacts must be arranged so as to surround the signal line contacts. This makes measures against the crosstalk and noise insufficient; and as a result, an increase in density may not be dealt with as a high-speed transmission connector. Also, directions of the signal line and ground contacts are different from each other, and therefore simultaneous connection of large numbers of the signal line and ground contacts requires significant attention, and also connecting time as a connector.

An object of the present invention is to provide a high-density connector for high-speed transmission that can deal with a further increase in density of signal line contacts and is simple in structure and can be easily connected.

To achieve the above-described object, a high-density connector for high-speed transmission that makes a connection between electrical components, according to the present invention, comprises: a female connector having a connector body formed with a plurality of contact accommodating concave portions, and a plurality of female contacts that are pressed into and held in the contact accommodating concave portions; and a male connector having a connector body formed with a plurality of slits, and a plurality of male contacts that are pressed into and held in the slits; wherein said female contacts are arranged in zigzag in a plurality of rows such that adjacent female contacts in a front-back direction are diagonally positioned to each other; said male contacts coming into contact with said female contacts are arranged in zigzag in a plurality of rows corresponding to the arrangement of said female contacts; and among the rows of said female contacts arranged in zigzag, two adjacent rows in the front-back direction are rows of a pair of signal line contacts, and one row on either side in the front-back direction of the rows of the pair of signal line contacts is a row of a ground contact.

Also, each of the plurality of female contacts used for the high-density connector for high-speed transmission of the present invention is preferably formed from a metal sheet that is punched out in a predetermined shape, and includes a pressing portion, an elastic deformation portion, a bent portion as a first folding portion, a pinch portion, a second folding portion, a fixing portion, a terminal portion, and a solder ball welded to the terminal portion, and is preferably configured to pinch at least a portion of a contact portion of said male contact that is inserted between said pressing portion and said pinch portion.

Further, each of the plurality of male contacts used for the high-density connector for high-speed transmission of the present invention is preferably formed from a metal sheet that is punched out in an L shape, and includes a contact portion that extends in a vertical direction, a fixing portion that is orthogonal to a lower end of the contact portion at one end thereof and extends in a horizontal direction, a terminal portion that extends downward from a central portion in the horizontal direction of the fixing portion, and a solder ball welded to a front surface or a back surface of the terminal portion.

Still further, among the contact accommodating concave portions into which the female contacts are pressed, a contact accommodating concave portion into which the ground female contact is pressed is further preferably formed with an accommodating groove portion having one end that extends in a left or right direction to the extent of exceeding a contact accommodating concave portion that is diagonally adjacent in the front-back direction and accommodates a signal line contact, and the other end that is communicatively connected to the contact accommodating concave portion that accommodates the ground contact. Also, preferably, among the plurality of male contacts, in a ground male contact, widths of the contact portion and the fixing portion are the same. A width of the ground male contact is almost equal to a length that is added a width of the contact accommodating concave portion of said female contact which accommodates the ground male contact and a length in a left-right direction of said accommodating groove portion communicated with the contact accommodating concave portion.

Yet further, the terminal portion of the ground male contact may extend downward from one side of the fixing portion in the left-right direction, and said solder ball may be welded to the front surface or the back surface of the terminal portion.

The high-density connector for high-speed transmission of the present invention is configured such that the plurality of male contacts constituting the male connector and the plurality of female contacts constituting the female connector are respectively arranged in zigzag; among the rows of the female contacts arranged in zigzag, two adjacent rows in the front-back direction are the rows of the pair of signal line contacts; and one row on either side in the front-back direction of the rows of the pair of signal line contacts is the row of the ground contact, and therefore a distance between the female contacts can be made larger. This enables an impedance matching between the signal line female contacts to be brought close to 100Ω that is necessary for high-speed transmission. Also, by arranging the ground female contact row between the rows of the pair of signal line contacts, even if the signal line contacts are highly densely arranged, crosstalk between signal line contacts adjacent to each other can be reduced.

The male and female contacts are simple in structure, and therefore can be easily manufactured. Further, they can easily respond to the arrangement of external electrodes of an electrical component to be connected.

Also, by increasing a width of the ground male contact, crosstalk between adjacent signal line contacts can be further reduced.

BEST MODE FOR CARRYING OUT THE INVENTION

A high-density connector for high-speed transmission according to the present invention will hereinafter be described with use of the drawings.

First Embodiment

Figure 1:
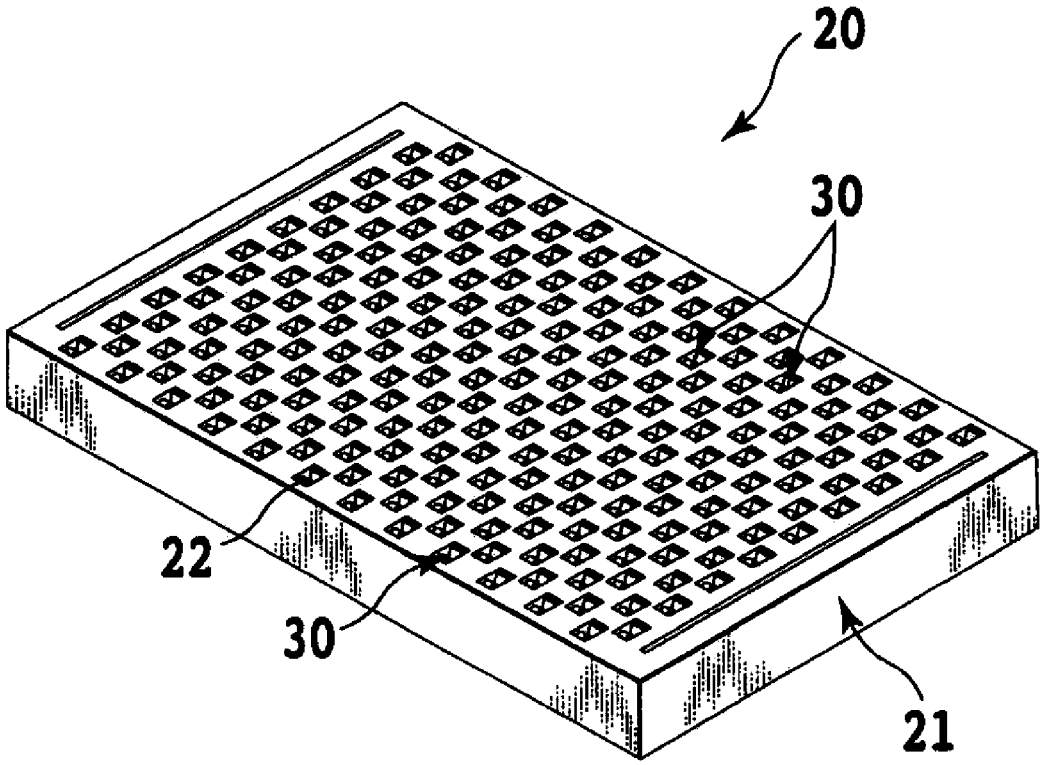
FIG. 1 is a perspective view of a female connector constituting a high-density connector for high-speed transmission according to a first embodiment of the present invention, as viewed from a top surface side.
Figure 2:
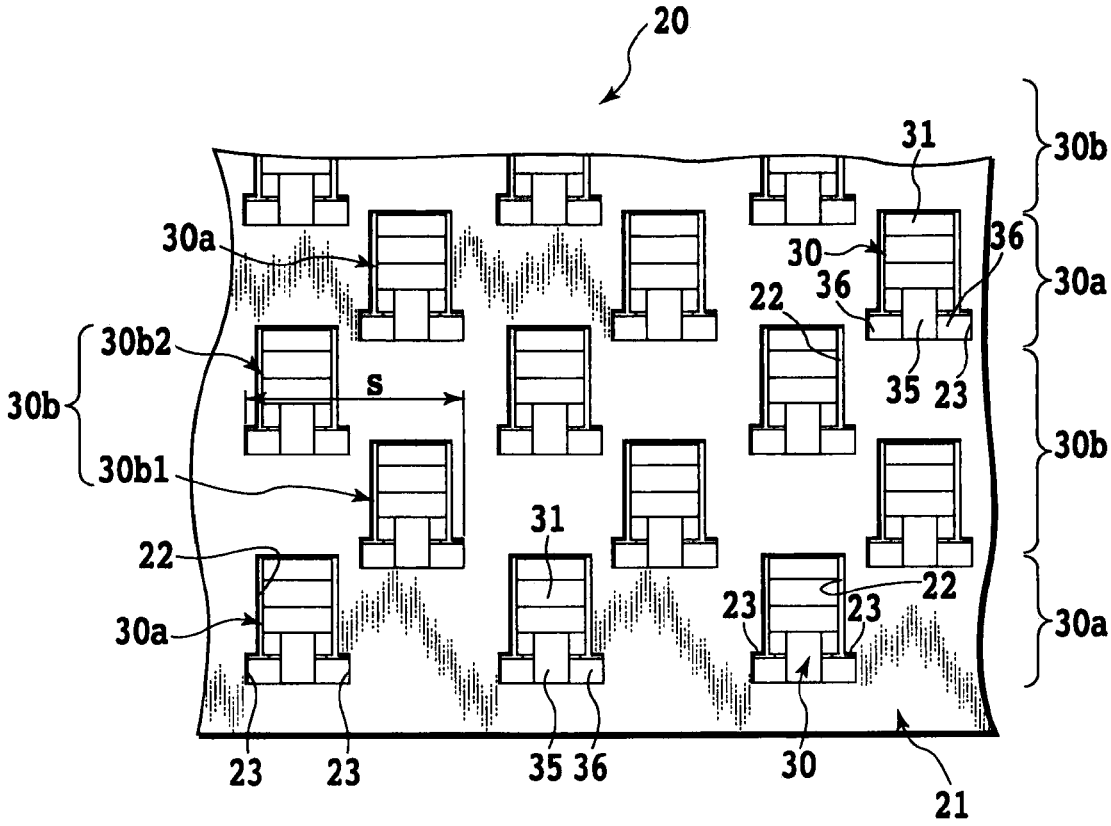
FIG. 2 is a partial enlarged top view of the female connector illustrated in FIG. 1.
Figure 3:
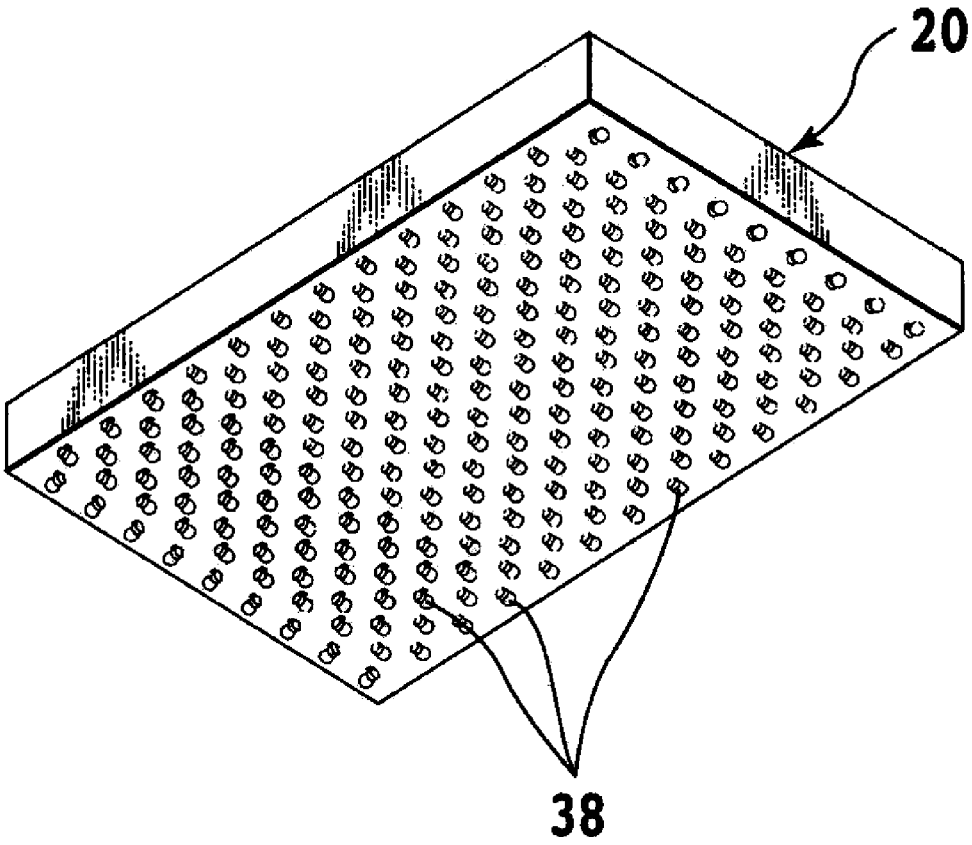
FIG. 3 is a perspective view of the female connector illustrated in FIG. 1 as viewed from a bottom surface side.
Figure 4A:
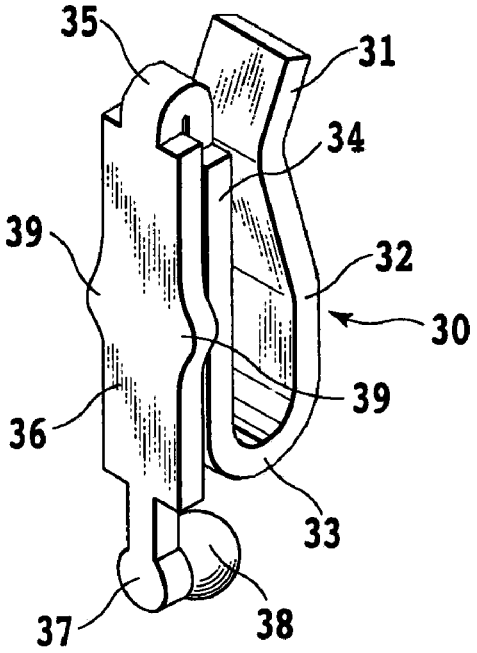
FIG. 4A is a perspective view of one example of a female contact used for the female connector illustrated in FIG. 1.
Figure 4B:
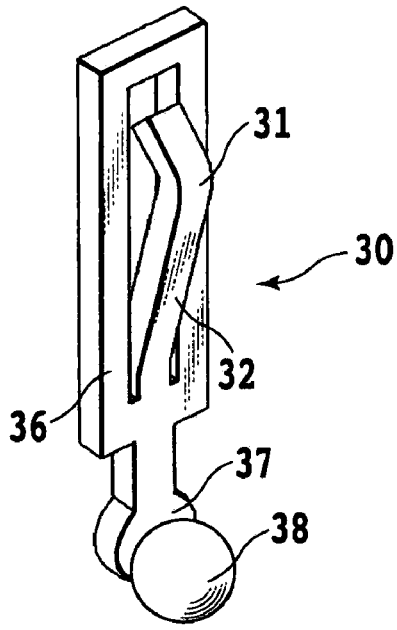
FIG. 4B is a perspective view of another example of the female contact used for the female connector illustrated in FIG. 1.
Figure 4C:
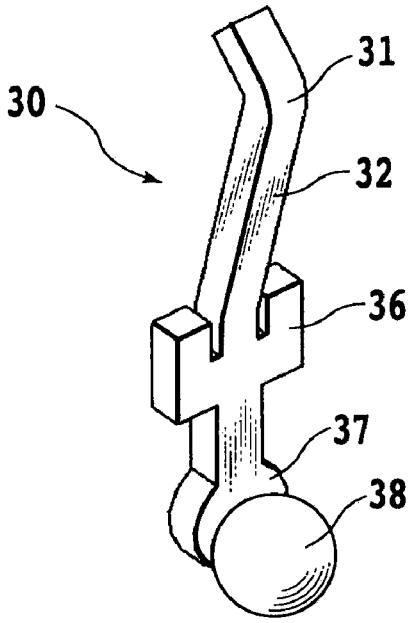
FIG. 4C is a perspective view of still another example of the female contact used for the female connector illustrated in FIG. 1.
Figure 5:
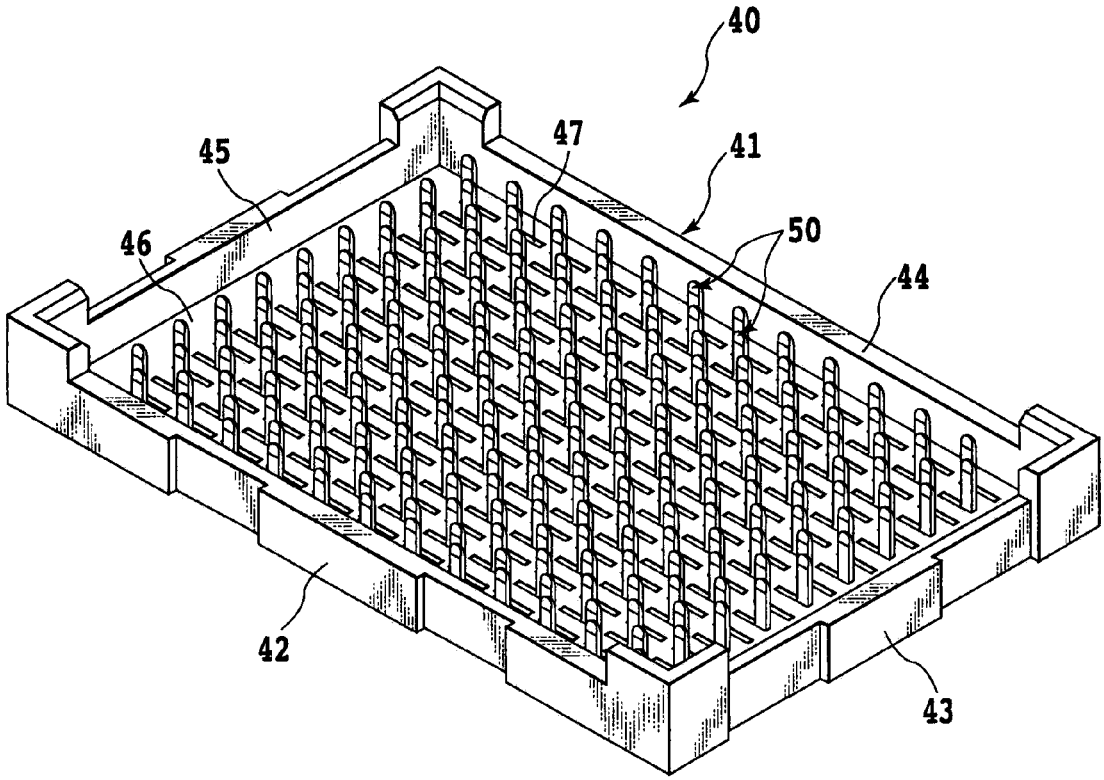
FIG. 5 is a perspective views of a male connector constituting the high-density connector for high-speed transmission according to the first embodiment of the present invention, as viewed from a top surface side.
Figure 6:
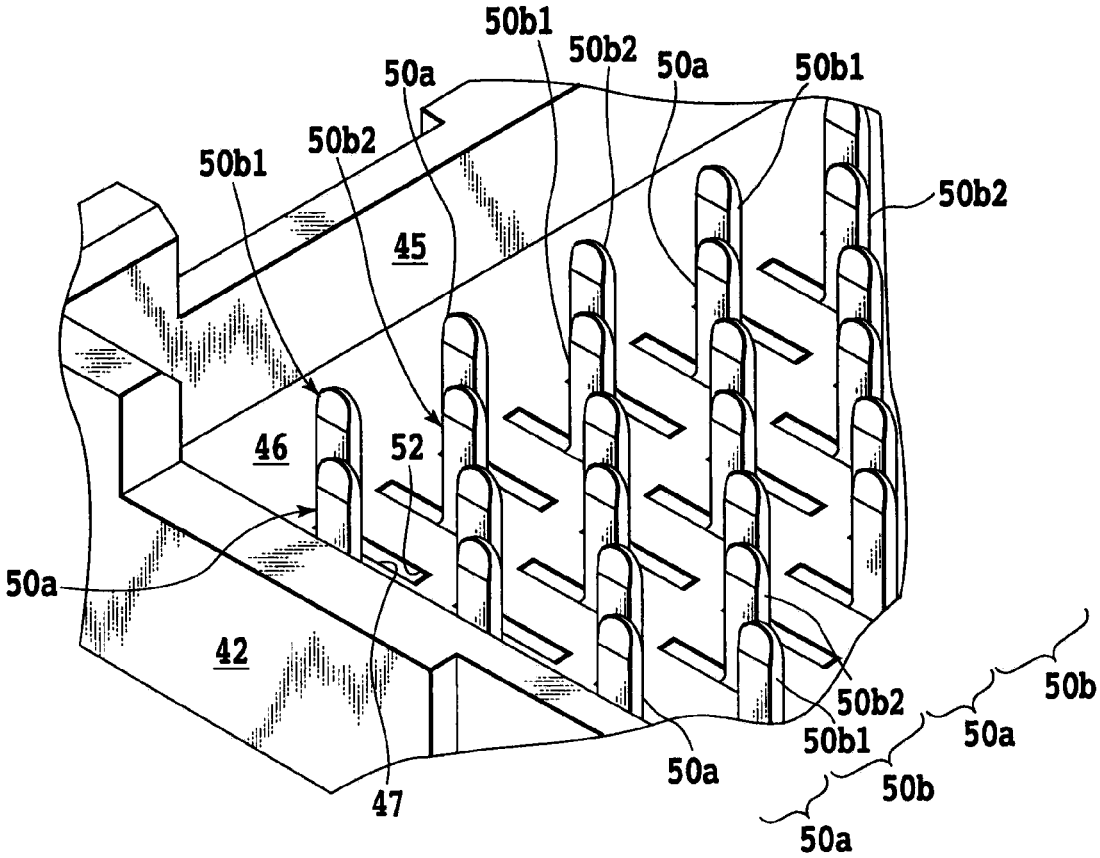
FIG. 6 is a partial enlarged perspective view of the male connector illustrated in FIG. 5 as viewed from the top surface side.
Figure 7:
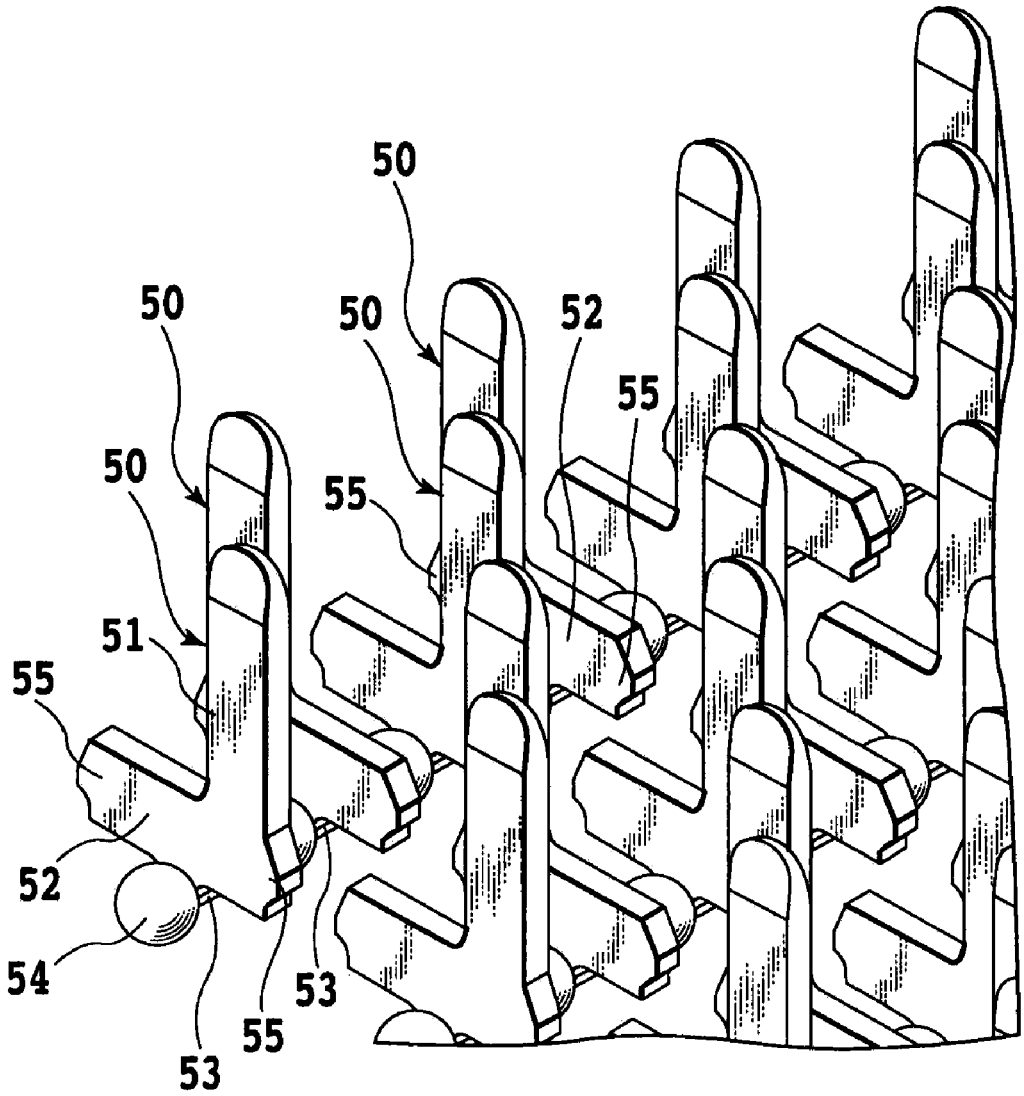
FIG. 7 is a partial enlarged perspective view illustrating male contacts used for the male connector illustrated in FIG. 5, and arrangement of the male contacts as viewed from above.
Figure 8A:
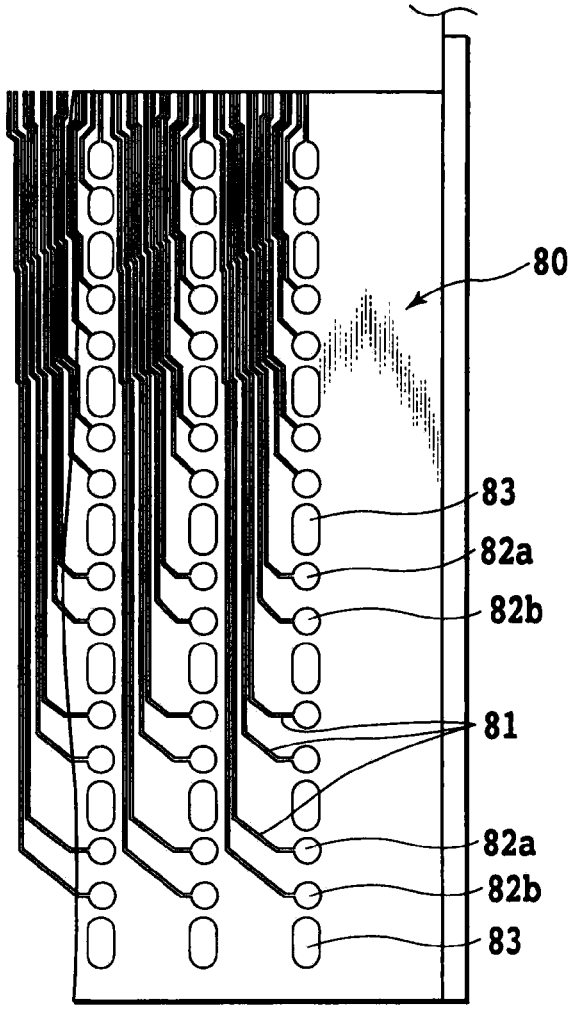
FIG. 8A is a partial enlarged top view illustrating an example of a wiring pattern of a flexible cable mounted with the male connector illustrated in FIG. 5, in which pads are arranged linearly.
Figure 8B:
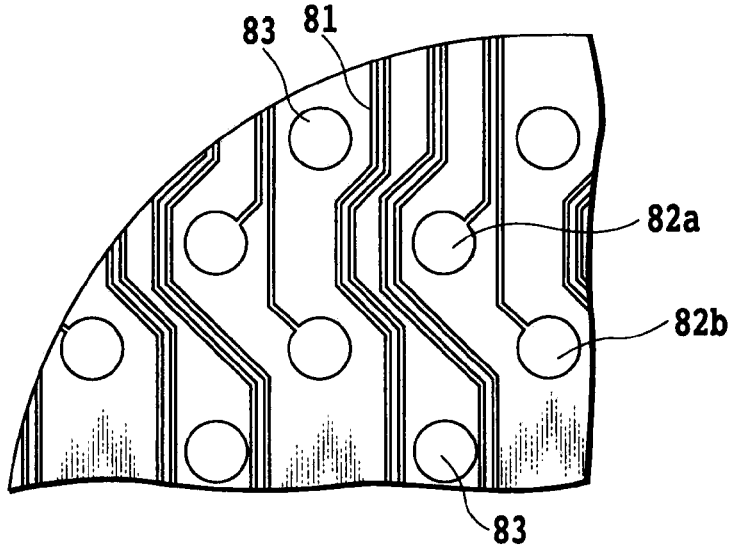
FIG. 8B is a partial enlarged top view illustrating another example of the wiring pattern of the flexible cable mounted with the male connector illustrated in FIG. 5, in which pads are arranged in zigzag.
Figure 9:
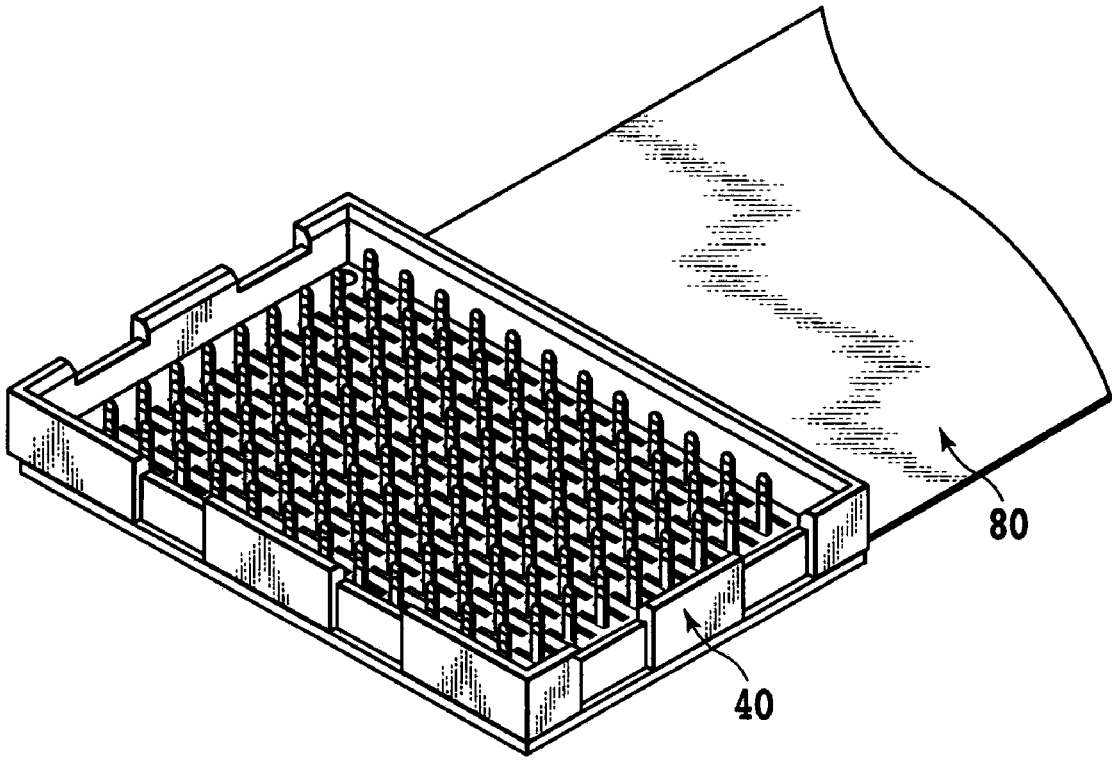
FIG. 9 is a perspective view illustrating a state where the male connector illustrated in FIG. 5 is mounted on the flexible cable.
Figure 10:
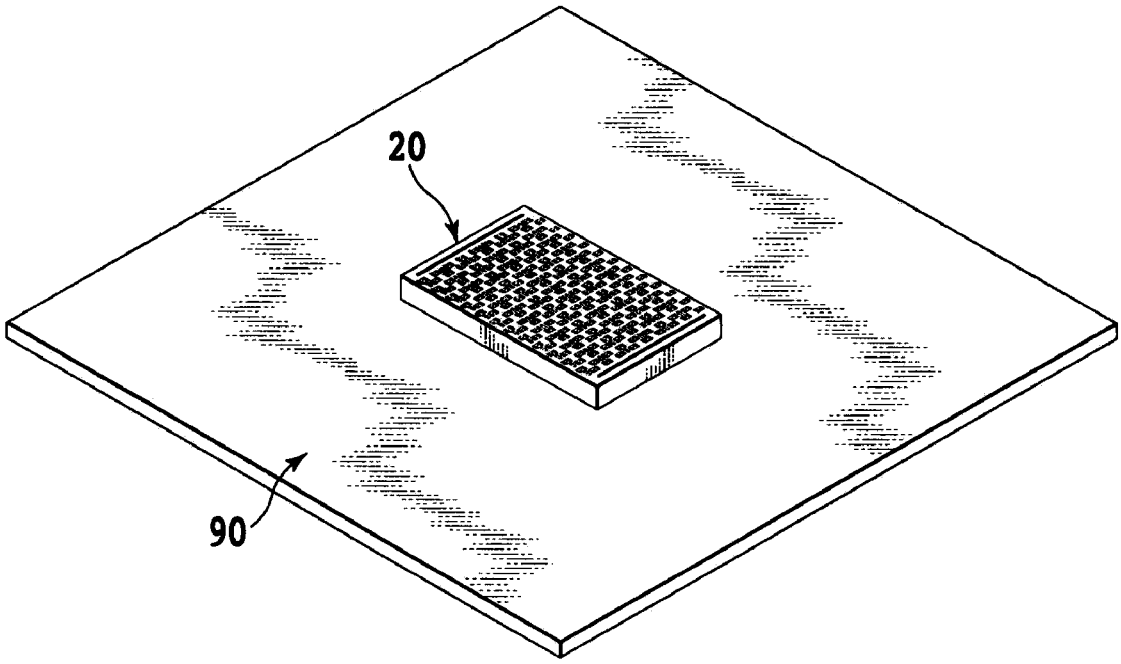
FIG. 10 is a perspective view illustrating a state where the female connector illustrated in FIG. 1 is mounted on a printed circuit board.
Figure 11:
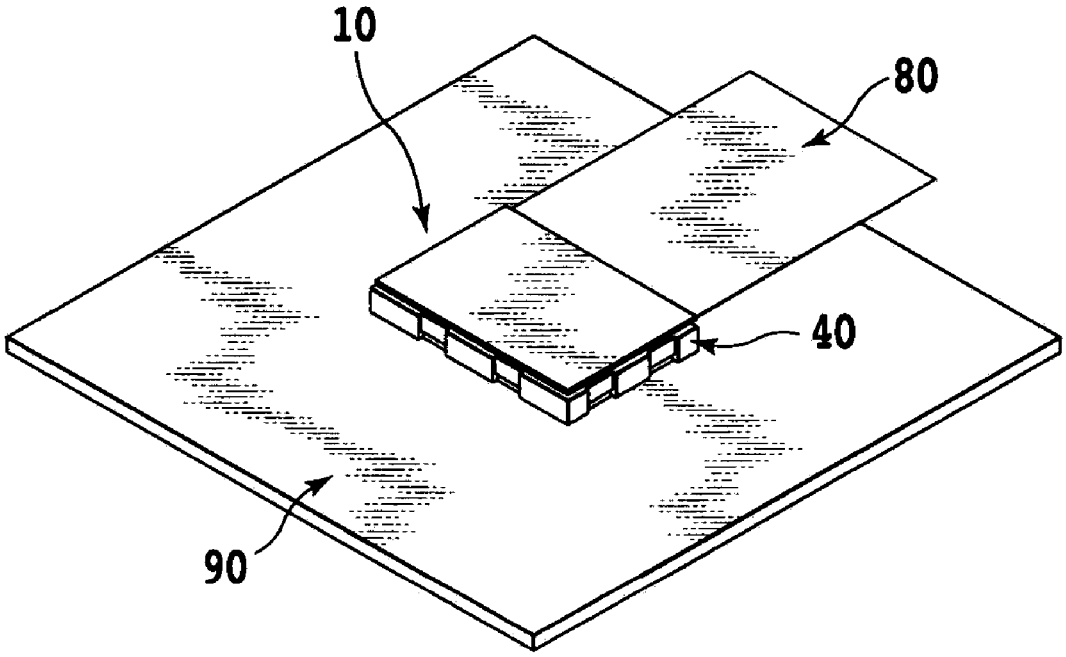
FIG. 11 is a perspective view illustrating a state where the female connector illustrated in FIG. 1 and the male connector illustrated in FIG. 5 are fitted into each other to electrically connect the flexible cable and the printed circuit board to each other via the high-density connector for high-speed transmission according to the present invention.

FIGS. 1 to 11 illustrate a first embodiment of the present invention. FIG. 1 is a perspective view of a female connector constituting a high-density connector for high-speed transmission according to the first embodiment of the present invention, as viewed from a top surface side. FIG. 2 is a partial enlarged top view of the female connector illustrated in FIG. 1. FIG. 3 is a perspective view of the female connector illustrated in FIG. 1 as viewed from a bottom surface side. FIGS. 4A to 4C are perspective views of a female contact single body used for the female connector illustrated in FIG. 1, and respectively illustrate one example, another example, and still another example. FIG. 5 is a perspective view of a male connector constituting the high-density connector for high-speed transmission according to the first embodiment of the present invention, as viewed from a top surface side. FIG. 6 is a partial enlarged perspective view of the male connector illustrated in FIG. 5 as viewed from the top surface side. FIG. 7 is a partial enlarged perspective view illustrating male contacts used for the male connector illustrated in FIG. 5, and arrangement of the male contacts as viewed from above. FIGS. 8A and 8B illustrate wiring patterns of a flexible cable mounted with the male connector illustrated in FIG. 5, in which FIG. 8A is a partial enlarged top view of the pattern in which pads are arranged linearly as one example, and FIG. 8B is a partial enlarged top view of the pattern in which pads are arranged in zigzag as another example. FIG. 9 is a perspective view illustrating a state where the male connector illustrated in FIG. 5 is mounted on the flexible cable. FIG. 10 is a perspective view illustrating a state where the female connector illustrated in FIG. 1 is mounted on a printed circuit board. FIG. 11 is a perspective view illustrating a state where the female connector illustrated in FIG. 1 and the male connector illustrated in FIG. 5 are fitted into each other to electrically connect the flexible cable and the printed circuit board to each other via the high-density connector for high-speed transmission according to the present invention.

The high-density connector for high-speed transmission 10 in the present embodiment electrically connects the flexible cable 80 and the printed circuit board 90 to each other as illustrated in FIGS. 9 to 11. The high-density connector for high-speed transmission 10 in the present embodiment includes the male connector 40 mounted on the flexible cable 80, and the female connector 20 mounted on the printed circuit board 90 as illustrated in FIG. 9.

The female connector 20 in the present embodiment includes a connector body 21 and a plurality of female contacts 30 as illustrated in FIG. 1.

The connector body 21 is made of electrically-insulated synthetic resin, and formed as a plate-like body having a substantially rectangular horizontal cross sectional shape. In the connector body 21, there are formed a plurality of contact accommodating concave portions 22 each of which is vertically long and narrow, and has a substantially rectangular horizontal cross sectional shape. The plurality of contact accommodating concave portions 22 are arranged in zigzag at predetermined pitches as illustrated in FIG. 2. Into each of the contact accommodating concave portions 22, a female contact 30 (described later) is inserted one by one. On one side of the rectangular contact accommodating concave portion 22 (lower side in FIG. 2), press-fitting grooves 23 into which protrusions 39 formed on both left and right sides of a fixing portion 36 of the female contact 30 are pressed are symmetrically formed on right and left sides of the contact accommodating concave portion 22. Also, on the side where the press-fitting grooves 23 and 23 of the contact accommodating concave portion 22 are formed, there is formed a penetration hole (not illustrated) that vertically penetrates through the connector body 21 from a bottom surface of the contact accommodating concave portion 22. The penetration hole has a horizontal cross section through which a solder ball 38 of the female contact 30 can protrude.

Each of the female contacts 30 in the present embodiment is formed by folding twice an elongated plate, which is punched in a predetermined shape out of an electrically conductive metal sheet, in a substantially Z shape as viewed from the side, as illustrated in FIG. 4A in detail. The female contact 30 includes, as illustrated in FIG. 4A, a pressing portion 31, elastic deformation portion 32, bent portion or a first folding portion 33, pinch portion 34, second folding portion 35, fixing portion 36, terminal portion 37, and solder ball 38 welded to a back surface of the terminal portion 37.

The pressing portion 31 that is one end portion of the elongated plate is, as illustrated in FIG. 4A, formed in a dog-leg shape and is located substantially vertically above the female contact 30 and is followed by the elastic deformation portion 32 below. A lower end of the elastic deformation portion 32 is folded back upward via the bent portion 33 as the first folding portion, and continuous to the pinch portion 34. The pinch portion 34 is vertically disposed so as to face the pressing portion 31. The pinch portion 34 pinches a male contact 50 (described later) of the male connector 40 with the pressing portion 31 applied with spring force of the bent portion 33 caused by elastic deformation of the elastic deformation portion 32, and electrically connects the female connector 20 and male connector 40 to each other. An upper end of the pinch portion 34 is folded back again downward via the second folding portion 35, and continuous to the fixing portion 36. The fixing portion 36 is vertically disposed so as to face the pinch portion 34. On both left and right sides of the fixing portion 36, protrusions 39 and 39 are provided; and pressed into the press-fitting grooves 23 and 23 of the contact accommodating concave portion 22 provided in the above connector body 21 to thereby fix and support the female contact 30 to the connector body 21. A lower end of the fixing portion 36 is continuous to the terminal portion 37 that is the other end portion of the elongated plate. The terminal portion 37 is attached with the solder ball 38 that is to be connected to a pad serving as an external electrode of the printed circuit board 90. The terminal portion 37 is disposed so as to extend downward beyond a lower end of the bent portion or the second folding portion 33.

The female contacts 30 are respectively inserted into the contact accommodating concave portions 22 provided in the connector body 21 of the female connector 20. At this time, the protrusions 39 and 39 of the fixing portion 36 of the female contact 30 are pressed into the press-fitting grooves 23 and 23 formed on the left and right sides of the penetration hole until the lower end of the bent portion 33 of the female contact 30 comes into abutting contact with the bottom surface of the contact accommodating concave portion 22. Also, the terminal portion 37 of the female contact 30 and the solder ball 38 attached thereto penetrate through the penetration hole of the connector body 21, and protrude downward from the connector body 21 (see FIG. 3).

In the present embodiment, the female contact 30 is configured as described above; however, a shape of the female contact 30 is not limited to this. For example, as illustrated in FIGS. 4B and 4C, the female contact 30 may have a substantially linear shape formed such that the terminal portion 37 vertically extends directly downward through the fixing portion 36 from the lower end of the elastic deformation portion 32 in the present embodiment. In this case, the pinch portion 34 is not present, and therefore, the pressing portion 31 simply comes into press contact with the male contact 50.

As described, the female contact 30 is simple in structure in either case, and can be easily pressed into the contact accommodating concave portion 22 provided in the connector body 21, so that the female connector 20 can be easily manufactured.

As described above, in the present embodiment, the female contact 30 illustrated in FIG. 4 is inserted and fixed into each of the contact accommodating concave portions 22 that are provided in the connector body 21 with being arranged in zigzag. As a result, the female contacts 30 are arranged in zigzag. This sort of arrangement can make a pitch between the female contacts 30 smaller in a front-back or left-right direction to thereby enable the female contacts 30 to be further highly densely arranged. Further, in the present embodiment, as illustrated in FIG. 2, among rows of the female contacts 30 that are arranged in rows in the left-right direction, two adjacent rows in the front-back direction are configured to serve as signal line female contacts **30*b*1 and 30*b*2. Also, the female contacts 30*b*1 and 30*b*2 that are arranged diagonally in the front-back direction, that is, arranged in zigzag, make a pair, and constitute a signal line female contact pair 30*b* through which a signal goes back and forth. Further, one row arranged on either side in the front-back direction of the two rows of signal line female contacts 30*b*1 and 30*b*2, that is, the rows of the signal line female contact pair 30*b*, is configured to be a ground female contact 30*a*. As described, by arranging in zigzag the signal line female contacts 30*b*1 and 30*b*2 that form the signal line female contact pair 30*b*, a distance between the signal line female contacts 30*b*1 and 30*b*2 can be made larger. This enables an impedance matching between the signal line female contacts 30*b*1 and 30*b*2 to be brought close to 100Ω that is necessary for high speed transmission. Also, by arranging the row of the ground female contacts 30*a* between the rows of the signal line contact pairs 30*b*, even if the signal line contacts 30*b*1 and 30*b*2 are highly densely arranged, crosstalk between the adjacent signal line contact pairs 30*b*** can be reduced.

Next, the male connector 40 in the present embodiment corresponds to the female connector 20, of which respective contacts are electrically connectable members, and as illustrated in FIG. 5, includes a connector body 41 and the plurality of male contacts 50.

The connector body 41 of the male connector 40 is made of electrically insulated synthetic resin; includes front and back sidewalls 42 and 44, left and right sidewalls 43 and 45, and a bottom wall 46; and is formed in a box shape. The connector body 41 is configured to be able to enclose the connector body 21 of the female connector 20 with the front and back sidewalls 42 and 44, left and right sidewalls 43 and 45, and bottom wall 46 when the male connector 40 and female connector 20 are fitted into each other (see FIG. 11). On the bottom wall 46 of the connector body 41 of the male connector 40, a plurality of elongated slits 47 for holding the plurality of male contacts 50 are formed. The plurality of slits 47 extend in the left-right direction of the bottom wall 46, and vertically penetrate through the bottom wall 46. The plurality of formed slits 47 are arranged in a matrix form at the same pitches as those of the contact accommodating concave portions 22 of the female connector 20. The plurality of slits 47 have the same length in the left-right direction, which is approximately equal to the length S (see FIG. 2) including the two contact accommodating concave portions 22 of the above-described female connector 20, which are arranged in zigzag and diagonally adjacent to each other in the front-back direction.

Each of the male contacts 50 in the present embodiment is, as best illustrated in FIG. 7, formed by being punched in a substantially L shape out of an electrically conductive metal sheet. The male contact 50 includes a contact portion 51, fixing portion 52, terminal portion 53 (further, see FIG. 18A), and solder ball 54 welded to a front or back surface of the terminal portion 53.

The contact portion 51 vertically extends in the top-bottom direction, of which an upper portion is formed with an inclined surface so as to become tapered upward in the front-back direction, and a lower portion is continuous to the fixing portion 52. The fixing portion 52 is formed so as to horizontally extend in the left-right direction, and be orthogonal to the contact portion 51 at one end thereof. On both left and right sides of the fixing portion 52, protrusions 55 and 55 are formed, and a length of the fixing portion 52 including the protrusions 55 in the left-right direction is slightly longer than the length of the slit 47 in the left-right direction formed on the bottom wall 46 of the above-described connector body 41. The fixing portion 52 is pressed into the slit 47 of the connector body 41 to thereby fix the male contact 50 to the connector body 41. The terminal portion 53 is formed so as to protrude downward at a central portion in the left-right direction of the fixing portion 52, and the solder ball 54 is welded to the front or back surface of the terminal portion 53.

In the present embodiment, there are prepared the male contact 50 in which the solder ball 54 is welded to the front surface of the terminal portion 53, and that 50 in which the solder ball 54 is welded to the back surface of the terminal portion 53. The reason why such kinds of the male contacts 50 are prepared as described is because, in the present embodiment, signal line pads 82*a* and 82*b* and ground pads 83 that are external electrodes of signal lines 81 are lineally arranged on the flexible cable 80 mounted with the male connector 40 as illustrated in FIG. 8A. (Note that a ground line of the flexible cable 80 is formed on the unillustrated entire surface on a back surface side of the flexible cable 80, and connected to the ground pads 83 via bumps or the like.)

As illustrated in FIG. 7, the solder balls 54 are directed to the same side (front side in the present embodiment) with respect to the terminal portions 53 to press and fix the fixing portions 52 of the male contacts 50 into the slits 47 of the connector body 41 from the lower side. At this time, the solder balls 54 of the male contacts 50, which come into contact with the signal line pads 82*a* and 82*b* and ground pads 83 of the flexible cable 80, can be lineally arranged at the same pitches, and the contact portions 51 of the male contacts 50 can be arranged in zigzag so as to correspond to the zigzag arrangement of the female contacts 30.

Figure 18A:
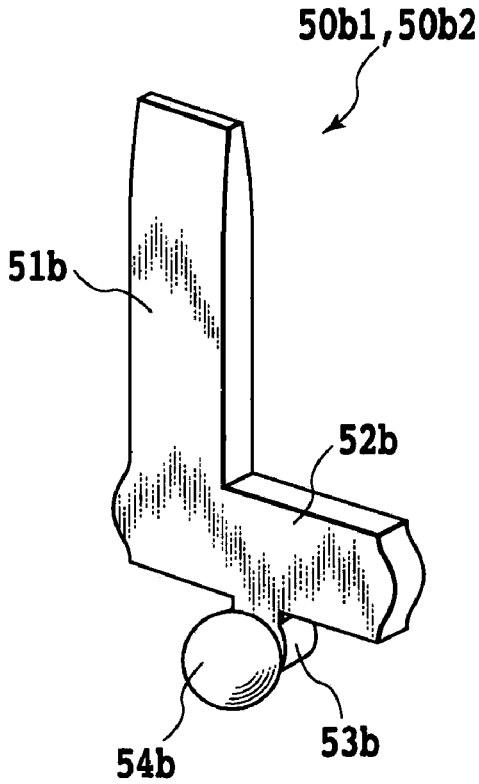
FIG. 18A is a perspective view of one example of a signal line male contact used for the male connector illustrated in FIG. 15.
Figure 18B:
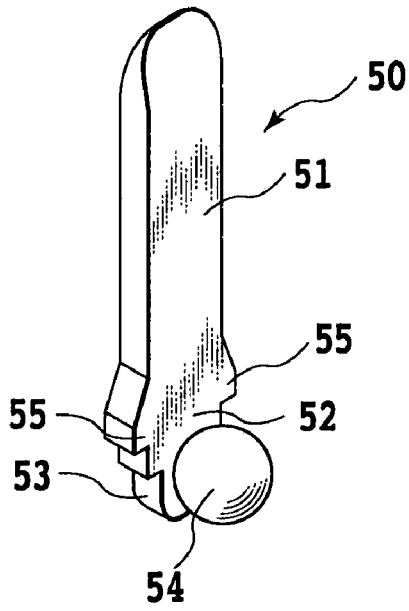
FIG. 18B is a perspective view of another example of the signal line male contact used for the male connector illustrated in FIG. 15.

Note that, for example, if the pads serving as the external electrodes of the flexible cable 80 to be mounted are, as illustrated in FIG. 8B, arranged in zigzag, a shape of the male contact 50 may be formed such that the contact portion 51, fixing portion 52, terminal portion 53, and solder ball 54 are linearly present in the top-bottom direction (see FIG. 18B). In addition, in this case, the slits 47 formed on the bottom wall 46 of the connector body 41 are arranged in zigzag.

As described, the male contact 50 in the present embodiment is also simple in structure, and can be easily pressed into the slit 47, so that the male connector 40 can be easily manufactured.

Regarding the male contacts 50 (more specifically, their contact portions 51), as illustrated in FIG. 6 in detail, among rows of the male contacts 50 arranged in the left-right direction in rows, two adjacent rows in the front-back direction are configured to be signal line male contacts 50*b*1 and 50*b*2 corresponding to the female contacts 30. Also, the signal line male contacts 50*b*1 and 50*b*2 that are arranged diagonally in the front-back direction, that is, arranged in zigzag, make a pair, and constitute a signal line male contact pair 50*b* through which a signal goes back and forth. Further, one row arranged on either side in the front-back direction of the two rows of signal line male contacts 50*b*1 and 50*b*2 is configured to be a ground male contact 50*a*.

The female connector 20 and male connector 40 configured as described above are, in the present embodiment, mounted on the printed circuit board 90 and flexible cable 80 respectively as illustrated in FIGS. 9 and 10. At this time, the solder balls 38 and 54 respectively welded to the female contacts 30 of the female connector 20 and the male contacts 50 of the male connector 40 are connected to corresponding pads of the printed circuit board 90 and flexible cable 80, respectively, with reflow soldering. Then, as illustrated in FIG. 11, the male connector 40 is fitted into the female connector 20. Based on this, the contact portion 51 of the male contact 50 of the male connector 40 is pinched at a desired contact pressure between the pressing portion 31 and pinch portion 34 of the female contact 30 provided in the female connector 20. As a result, the printed circuit board 90 and flexible cable 80 are electrically connected to each other.

Second Embodiment

Figure 12:
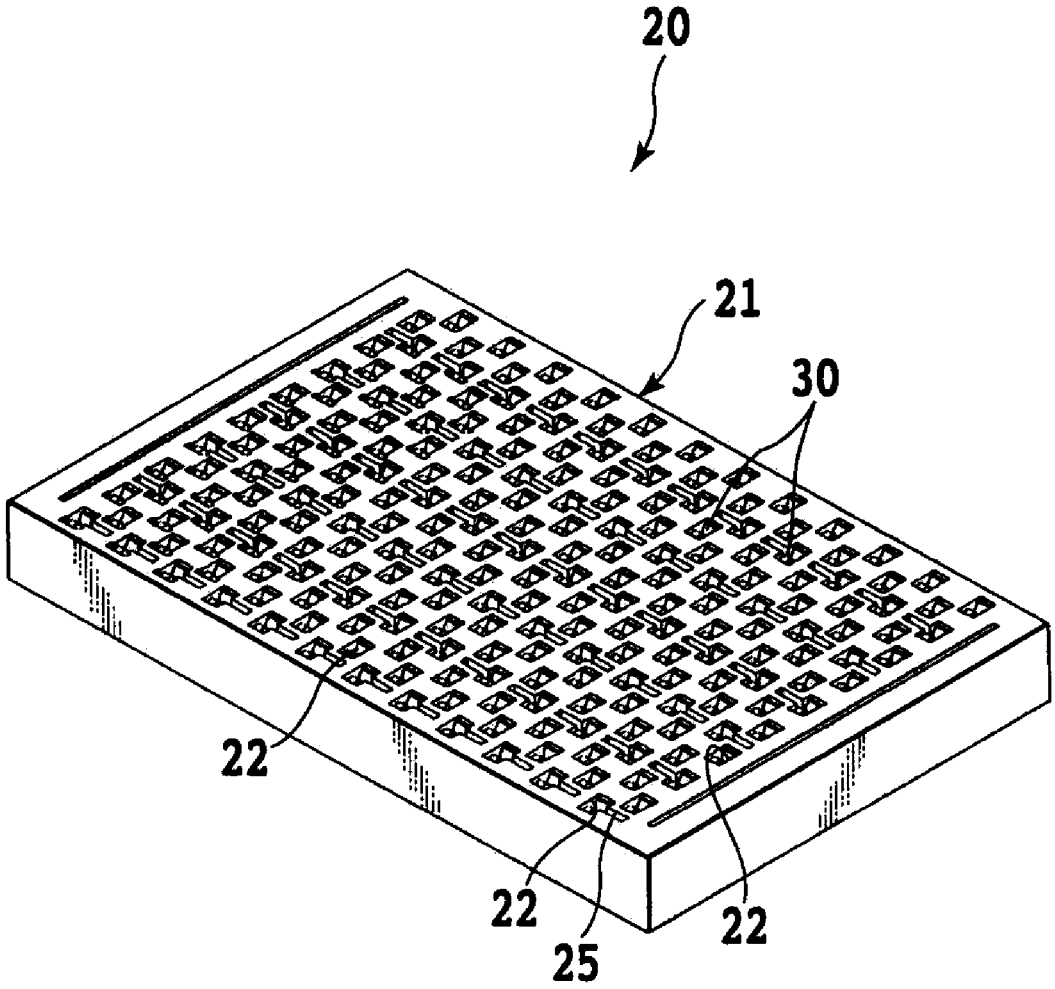
FIG. 12 is a perspective view of a female connector constituting a high-density connector for high-speed transmission according to a second embodiment of the present invention, as viewed from a top surface side.
Figure 13:
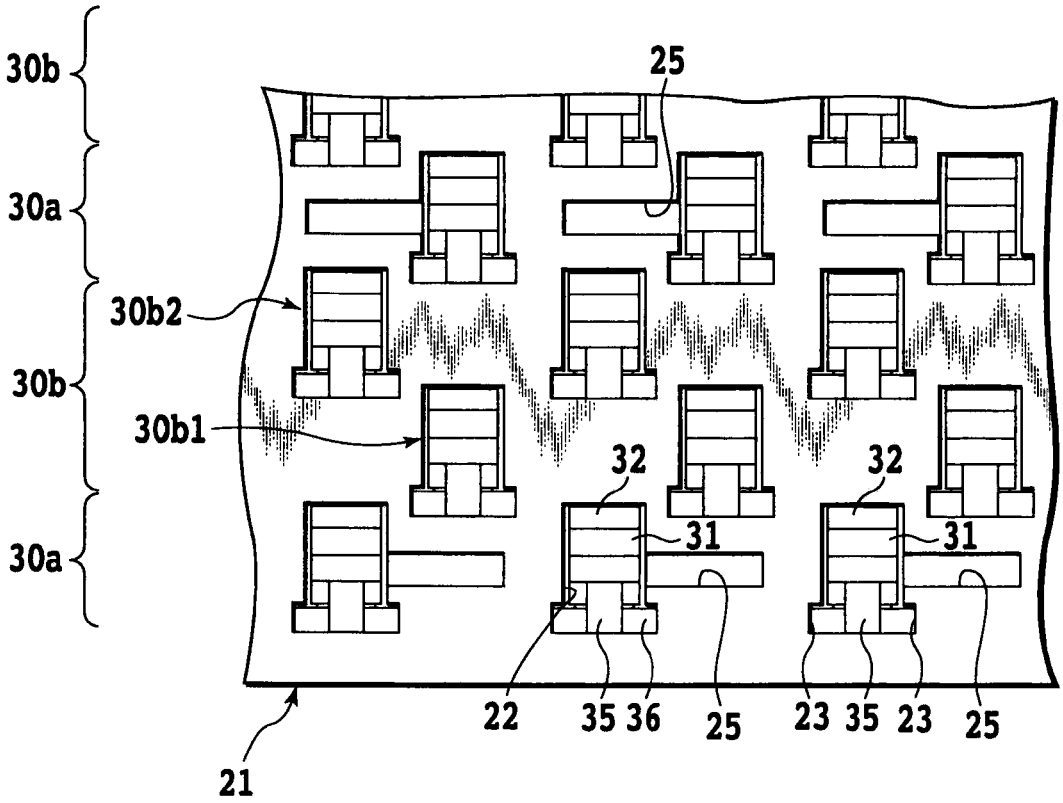
FIG. 13 is a partial enlarged top view of the female connector illustrated in FIG. 12.
Figure 14:
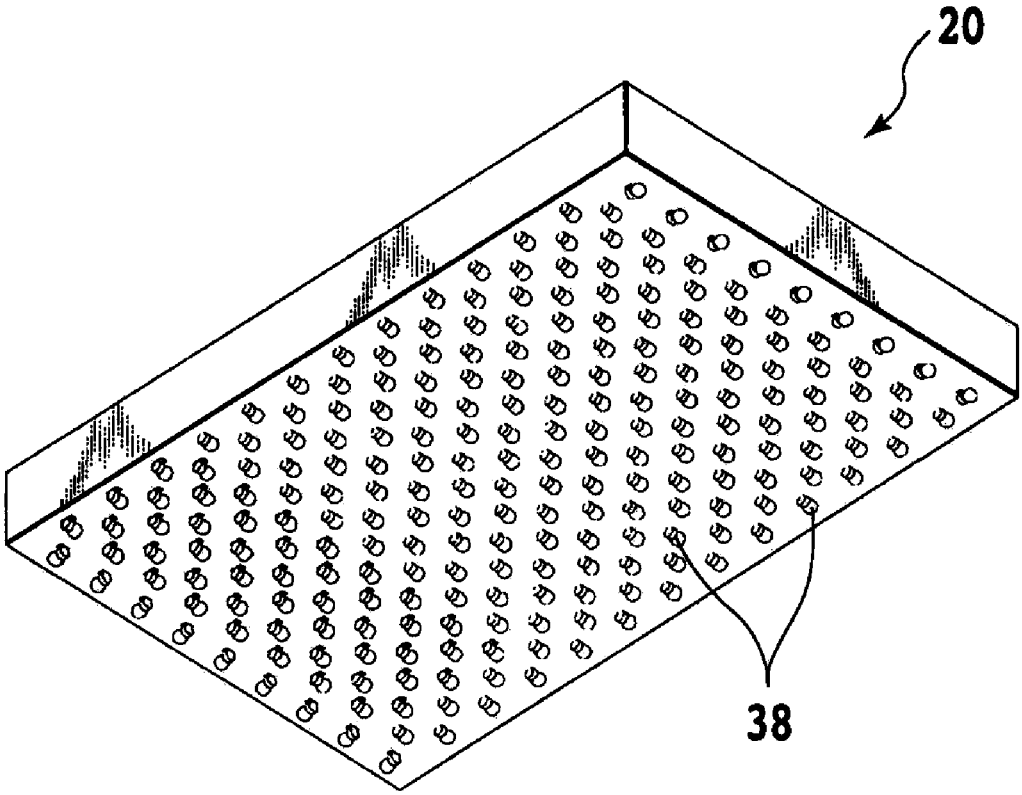
FIG. 14 is a perspective view of the female connector illustrated in FIG. 12 as viewed from a bottom surface side.
Figure 15:
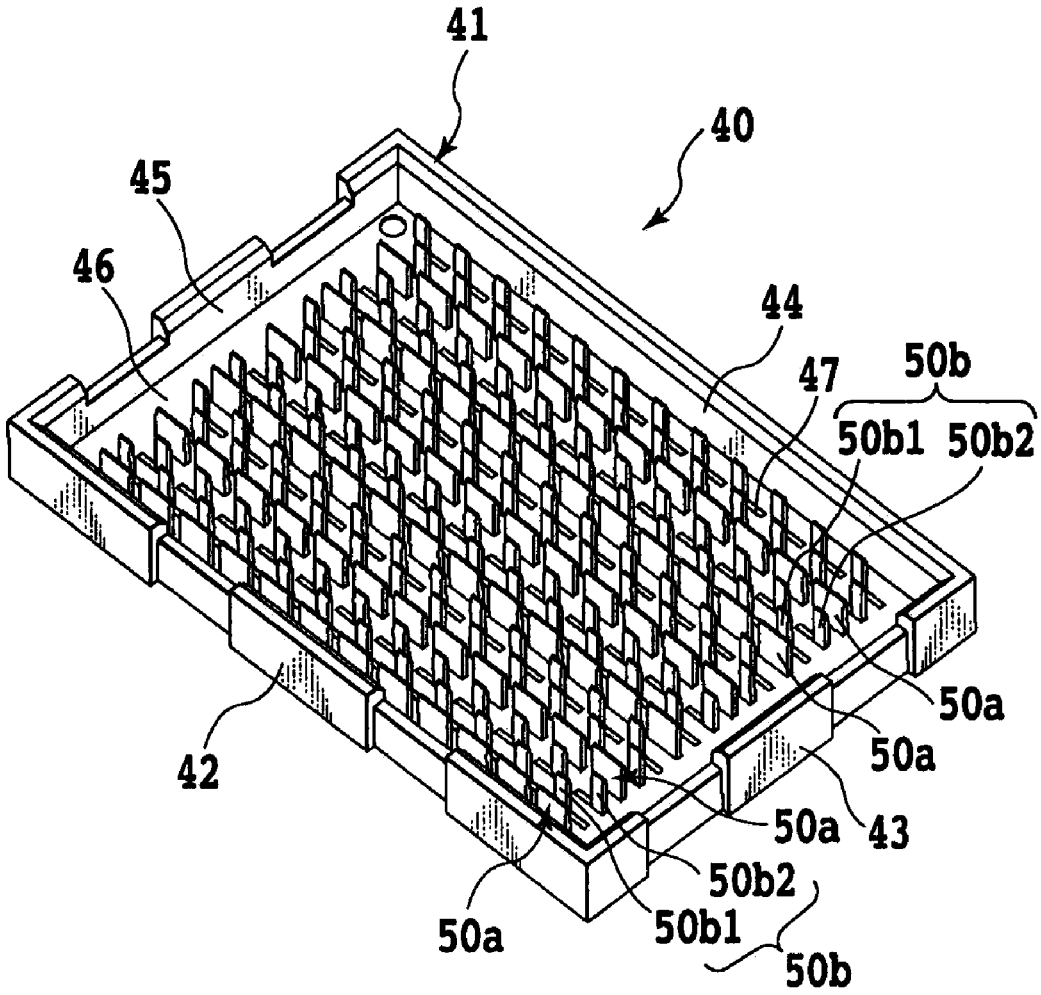
FIG. 15 is a perspective view of a male connector constituting the high-density connector for high-speed transmission according to the second embodiment of the present invention, as viewed from a top surface side.
Figure 16:
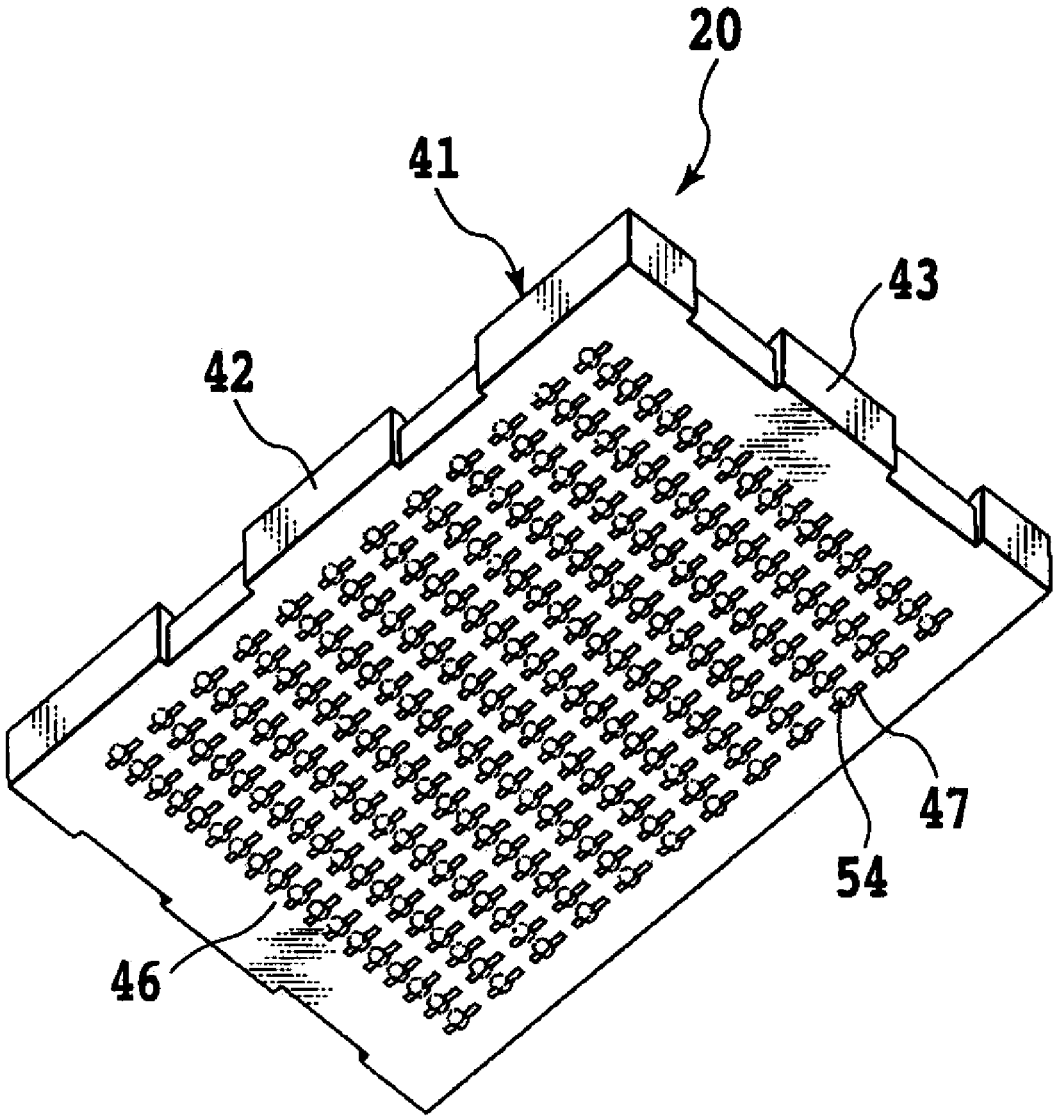
FIG. 16 is a perspective view of the male connector illustrated in FIG. 15 as viewed from a bottom surface side.
Figure 17:
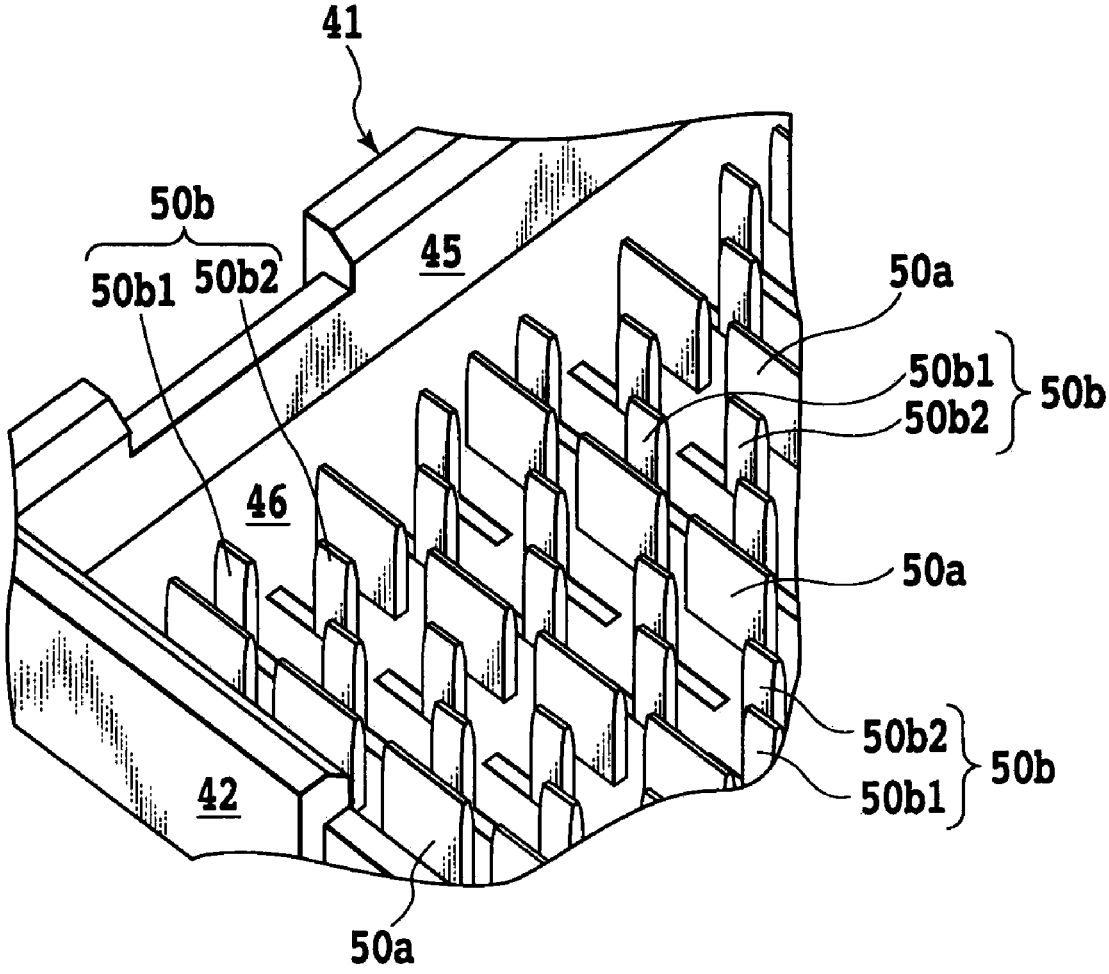
FIG. 17 is a partial enlarged perspective view of the male connector illustrated in FIG. 15 as viewed from the top surface side.

A second embodiment of the present invention is illustrated in FIGS. 12 to 20. FIG. 12 is a perspective view of a female connector constituting a high-density connector for high-speed transmission according to the second embodiment of the present invention, as viewed from a top surface side. FIG. 13 is a partial enlarged top view of the female connector illustrated in FIG. 12. FIG. 14 is a perspective view of the female connector illustrated in FIG. 12 as viewed from a bottom surface side. FIG. 15 is a perspective view of a male connector constituting the high-density connector for high-speed transmission according to the second embodiment of the present invention, as viewed from a top surface side. FIG. 16 is a perspective view of the male connector illustrated in FIG. 15 as viewed from a bottom surface side. FIG. 17 is a partial enlarged perspective view of the male connector illustrated in FIG. 15 as viewed from the top surface side. FIGS.

Figure 19:
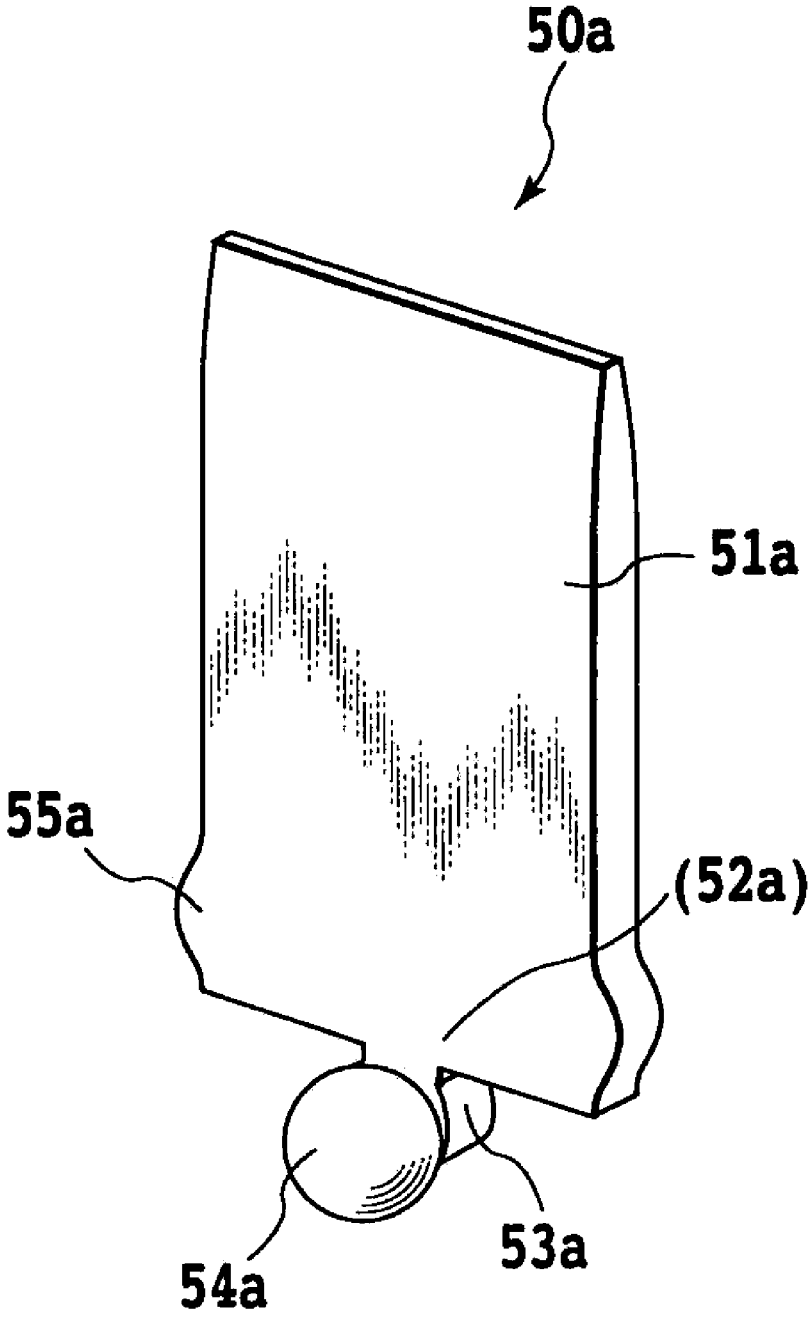
FIG. 19 is a perspective view of a ground male contact used for the male connector illustrated in FIG. 15.
Figure 20:
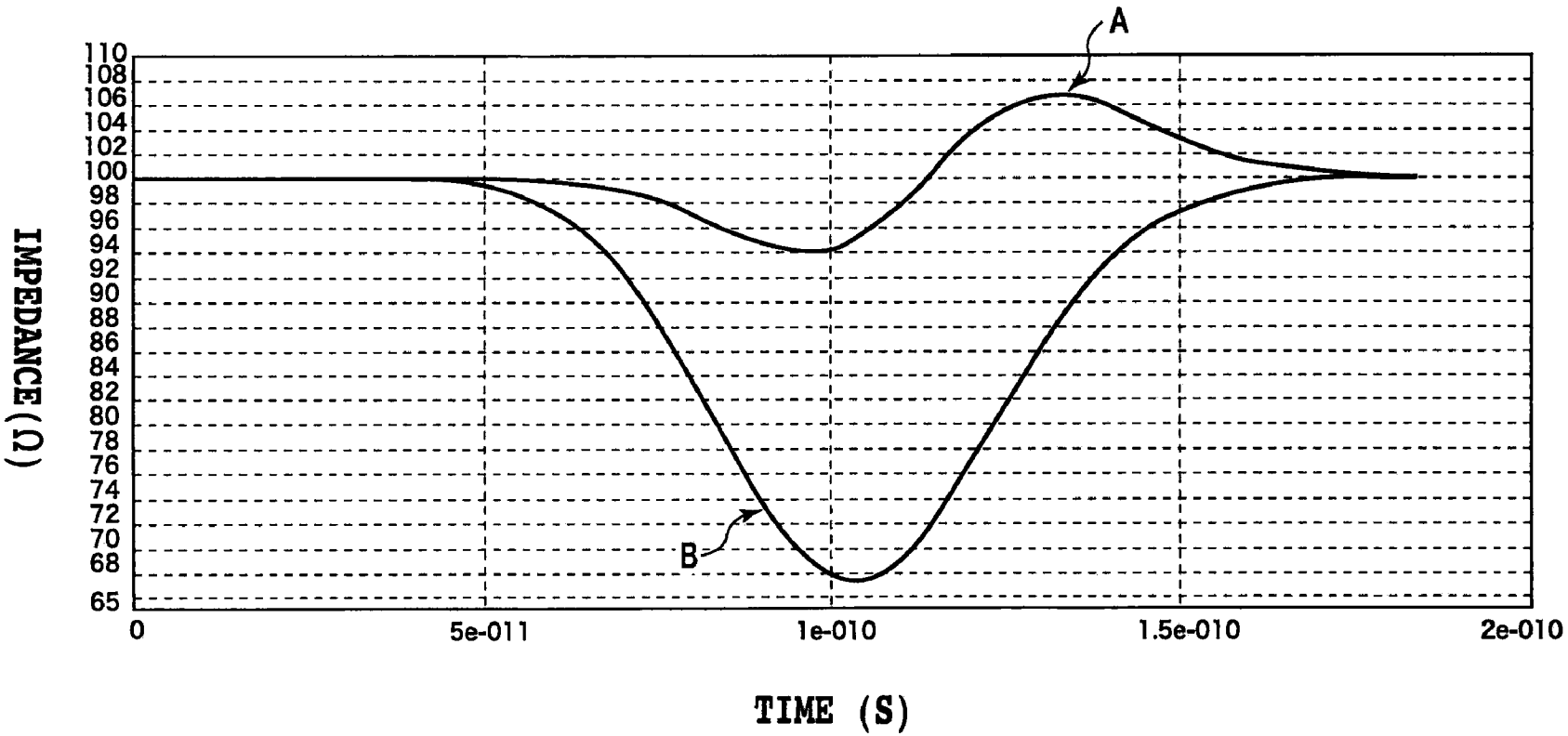
FIG. 20 is a diagram for describing difference in impedance matching between signal line contacts due to difference between conventional and present invention arrangements of signal line male contacts (or signal line female contacts).

18A and 18B are perspective views of a signal line male contact used for the male connector illustrated in FIG. 15, in which FIG. 18A illustrates one example, and FIG. 18B illustrates another example. FIG. 19 is a perspective view of a ground male contact used for the male connector illustrated in FIG. 15. FIG. 20 is a diagram for describing difference in impedance matching between signal line contacts due to difference between conventional and present invention arrangements of signal line male contacts (or signal line female contacts).

Similarly to the above-described first embodiment, the high-density connector for high-speed transmission in the present embodiment also electrically connects a flexible cable 80 and printed circuit board 90 to each other as illustrated in FIGS. 9 to 11. The high-density connector for high-speed transmission 10 in the present embodiment includes: the male connector 40 mounted on the flexible cable 80 having external electrodes that are linearly arranged as illustrated in FIG. 8A; and the female connector 20 mounted on the printed circuit board 90 having external electrodes that are arranged in zigzag. The present embodiment is different from the above-described first embodiment in shape of a ground male contact 50*a* among a plurality of male contacts 50 constituting the male connector 40, and along with this, different from the first embodiment in shape of a contact accommodating concave portion 22 constituting the female connector 20. The rest of a structure of the high-density connector for high-speed transmission 10 in the present embodiment is substantially the same as that of the above-described first embodiment. In the following, the differences will be described in detail, and an outline of the rest of the structure will be briefly described.

The female connector 20 of the present embodiment includes a connector body 21 and a plurality of female contacts 30 as illustrated in FIG. 12.

The connector body 21 in the present embodiment is made of electrically insulated synthetic resin, and formed as a plate-like body with a substantially rectangular horizontal cross sectional shape. The connector body 21 is exactly the same as that of the above-described first embodiment in that in the connector body 21, a plurality of contact accommodating concave portions 22 each including press-fitting grooves 23 and a penetration hole are arranged in zigzag at predetermined pitches as illustrated in FIG. 13. In the present embodiment, as illustrated in FIG. 13, in the connector body 21, there is formed an accommodating groove portion 25 that is communicatively connected to the contact accommodating concave portion 22 inserted with the ground female contact 30*a*, and inserted with an after-mentioned ground male contact 50*a*. The accommodating groove portion 25 is, when the ground female contact 30*a* is inserted into the contact accommodating concave portion 22, formed so as to extend in a left or right direction of the contact accommodating concave portion 22 from a position corresponding to a gap between a pressing portion 31 and a pinch portion 34 of the ground female contact 30*a*. The accommodating groove portion 25 is formed so as to be orthogonal to a sidewall that extends in a front-back direction and constitutes the contact accommodating concave portion 22 inserted with the ground female contact 30*a*. As illustrated in FIG. 13, the accommodating groove portion 25 extends leftward or rightward to a position almost beyond a contact accommodating concave portion 22 that is, in the front-back direction, diagonally adjacent to the accommodating concave portion 22 communicatively connected with the accommodating groove portion 25.

In the present embodiment, a plurality of female contacts 30 respectively inserted into the contact accommodating concave portions 22 of the connector body 21 have the same shape as that of the female contacts 30 described in the above first embodiment. That is, even in the present embodiment, any of the female contacts 30 used as the ground female contacts 30*a* and signal line female contacts 30*b*1 and 30*b*2 has the shape illustrated in FIG. 4A.

Next, the male connector 40 in the present embodiment corresponds to the female connector 20, of which respective contacts are electrically connectable members, and as illustrated in FIG. 15, includes a connector body 41 and a plurality of male contacts 50.

Similarly to the above-described first embodiment, the connector body 41 in the present embodiment is made of electrically insulated synthetic resin, and includes front and back sidewalls 42 and 44, left and right sidewalls 43 and 45, and a bottom wall 46, and on the bottom wall 46 of the connector body 41, a plurality of elongated slits 47 for holding the plurality of male contacts 50 are formed.

The respective male contacts 50 in the present embodiment are different from those in the first embodiment in that the ground male contact 50*a* and the signal line male contacts 50*b*1 and 50*b*2 are different from each other in configuration.

The signal line male contacts 50*b*1 and 50*b*2 have the same shape as that in the first embodiment as well illustrated in FIGS. 18A and 18B. That is, each of the signal line male contacts 50*b*1 and 50*b*2 is punched in a substantially L shape out of an electrically conductive metal sheet, and includes a contact portion 51*b*, fixing portion 52*b*, terminal portion 53*b*, and a solder ball 54*b* welded to a front or back surface of the terminal portion 53*b*. On both left and right sides of the fixing portion 52*b*, protrusions 55 are formed so as to be able to fix the signal line male contacts 50*b*1 and 50*b*2 to the connector body 41 by being pressed into the slit 47.

As illustrated in FIG. 19 in detail, the ground male contact 50*a* includes a contact portion 51*a*, fixing portion 52*a*, terminal portion 53*a*, and solder ball 54*a*. In the ground male contact 50*a* in the present embodiment, the contact portion 51*a* and the fixing portion 52*a* are continuous to each other with having the same length (width) in the left-right direction, and have a substantially rectangular shaped structure that is wide as viewed from the front. That is, the contact portion 51*a* has the same length as the left-right length of the slit 47 provided on the bottom wall 46 of the connector body 41. On both left and right sides of the fixing portion 52*a*, protrusions 55*a* and 55*a* that are intended to be pressed into the slit 47 are formed so as to protrude. The terminal portion 53*a* is formed so as to protrude downward at a central portion in the left-right direction of the fixing portion 52*a*, and the solder ball 54*a* is welded to a front surface of the terminal portion 53*a*.

Note that the male contacts 50 in the present embodiment have been described for the case where the signal line pads 82*a* and 82*b* and ground pads 83 serving as the external electrodes of the flexible cable 80 to be connected are linearly arranged as illustrated in FIG. 8A. However, in the case where the signal line pads 82*a* and 82*b* and ground pads 83 are arranged in zigzag as illustrated in FIG. 8B, each of the signal line male contacts 50*b*1 and 50*b*2 may be formed such that the contact portion 51, fixing portion 52, terminal portion 53, and solder ball 54 are present linearly in the top-bottom direction as illustrated in FIG. 18B. Also, regarding the ground male contact 50*a*, the terminal portion 53 is formed so as to protrude downward from one of left and right sides of the fixing portion 52, and the solder ball 54*a* is welded to the front or back surface of the terminal portion 53.

By configuring the ground male contact 50*a* in this manner, when the male connector 40 is overlapped with the female connector 20, a portion of the ground male contact 50*a* is pinched between the pressing portion 31 and pinch portion 34 of the corresponding female contact 30. Also, the remaining portion of the ground male contact 50*a* is accommodated within the accommodating groove portion 25 provided in the female connector 20. Based on this, the ground male contact 50*a* blocks a gap between the signal line male contact pair 50*b* (and signal line female contact pair 30*b*) that are adjacent to each other in the front-back direction. Therefore, it is possible to further suppress crosstalk between the signal line contact pair 30*b* or 50*b* forming the pair in comparison with the above-described first embodiment.

Similarly to the above-described first embodiment, regarding the male contacts 50 (more specifically, their contact portions 51), as illustrated in FIG. 15 in detail, among rows of the male contacts 50 arranged in the left-right direction in rows, two adjacent rows in the front-back direction are configured to be the signal line male contacts 50*b*1 and 50*b*2 corresponding to the female contacts 30. Also, the signal line male contacts 50*b*1 and 50*b*2 that are arranged diagonally in the front-back direction, that is, arranged in zigzag, make a pair, and constitute the signal line male contact pair 50*b* through which a signal goes back and forth. Further, one row arranged on either side in the front-back direction of the two rows of signal line male contacts 50*b*1 and 50*b*2 is configured to be a ground male contact 50*a*.

Similarly to the first embodiment, the female connector 20 and male connector 40 configured as described above are mounted on the printed circuit board 90 and flexible cable 80, respectively, as illustrated in FIGS. 9 and 10, and electrically connect the printed circuit board 90 and flexible cable 80 to each other.

INDUSTRIAL APPLICABILITY

The present specification has only described the examples in which the female and male connectors constituting the high-density connector for high-speed transmission according to the present invention are respectively mounted on the printed circuit board and flexible cable; however, the present invention is not limited to them. For example, the female connector may be mounted on the flexible cable, and the male connector may be mounted on the printed circuit board. Also, the high-density connector for high-speed transmission according to the present invention may connect printed circuit boards to each other or make a connection between flexible cables.

The invention claimed is:

1. A high-density connector for high-speed transmission that makes a connection between electrical components, the connector comprising:

a female connector having a connector body formed with a plurality of contact accommodating concave portions, and a plurality of female contacts that are pressed into and held in the contact accommodating concave portions; and a male connector having a connector body formed with a plurality of slits, and a plurality of male contacts that are pressed into and held in the slits, wherein:

each of said plurality of male contacts is formed from a metal sheet that is punched out in an L shape, and includes: a contact portion that extends in a vertical direction; a fixing portion that is orthogonal to a lower end of the contact portion at one end thereof, and extends in a horizontal direction; a terminal portion that extends downward from a central portion in the horizontal direction of the fixing portion; and a solder ball welded to a front surface or a back surface of the terminal portion, said female contacts are arranged in zigzag in a plurality of rows such that adjacent female contacts in a front-back direction are diagonally positioned to each other, said male contacts to be connected to said female contacts are arranged in zigzag in a plurality of rows corresponding to the arrangement of said female contacts, and among the rows of said female contacts arranged in zigzag, two adjacent rows in the front-back direction are rows of a pair of signal line contacts, and one row on either side in the front-back direction of the rows of the pair of signal line contacts is a row of a ground contact.

2. The high-density connector for high-speed transmission according to claim 1, wherein each of said plurality of female contacts is formed from a metal sheet that is punched out in a predetermined shape and includes a pressing portion, an elastic deformation portion, a bent portion as a first folding portion, a pinch portion, a second folding portion, a fixing portion, a terminal portion, and a solder ball welded to the terminal portion, and is configured to pinch at least a portion of a contact portion of said male contact that is inserted between said pressing portion and said pinch portion.

3. The high-density connector for high-speed transmission according to claim 1, wherein, among the contact accommodating concave portions into which said female contacts are pressed, a contact accommodating concave portion into which the ground female contact is pressed is further formed with an accommodating groove portion having: one end that extends in a left or right direction to an extent of exceeding a contact accommodating concave portion that is diagonally adjacent in the front-back direction and accommodates a signal line contact; and the other end that is communicatively connected to the contact accommodating concave portion that accommodates the ground contact, and among said plurality of male contacts, in a ground male contact, widths of the contact portion and the fixing portion are same, and a width of the ground contact is almost equal to a length of a width of the contact accommodating concave portion that accommodates the ground contact among said female contacts, the length being added with a length in a left-right direction of said accommodating groove portion communicatively connected to the contact accommodating concave portion.

4. The high-density connector for high-speed transmission according to claim 3, wherein the terminal portion of said ground male contact extends downward from one side of the fixing portion in the left-right direction, and said solder ball is welded to the front surface or the back surface of the terminal portion.

* * * * *